US006828261B2

(12) United States Patent
Soelch et al.

(10) Patent No.: US 6,828,261 B2
(45) Date of Patent: Dec. 7, 2004

(54) POLYMER ALLOYS INCLUDING TWO OR MORE COMPONENTS WITH DIFFERING MELTING POINTS, FILAMENTS MADE THEREOF, AND FABRICS MADE THEREFROM

(75) Inventors: Richard Robert Soelch, Essex Junction, VT (US); Gerry Bissonnette, Milton, VT (US)

(73) Assignee: AstenJohnson, Inc., Charleston, SC (US)

( * ) Notice: Subject to any disclaimer, the term of this patent is extended or adjusted under 35 U.S.C. 154(b) by 0 days.

(21) Appl. No.: 10/200,092

(22) Filed: Jul. 19, 2002

(65) Prior Publication Data

US 2004/0014386 A1 Jan. 22, 2004

(51) Int. Cl.[7] ..... D03D 15/00
(52) U.S. Cl. ..... 442/199; 442/301
(58) Field of Search ..... 442/199, 301

(56) References Cited

U.S. PATENT DOCUMENTS

| | | | | |
|---|---|---|---|---|
| 5,116,478 A | | 5/1992 | Tate et al. | |
| 5,324,392 A | | 6/1994 | Tate et al. | |
| 5,618,885 A | * | 4/1997 | Kotek et al. | 525/179 |
| 2002/0055310 A1 | | 5/2002 | Falk et al. | |

FOREIGN PATENT DOCUMENTS

| | | | | |
|---|---|---|---|---|
| JP | 04041792 A | * | 2/1992 | D21F/1/10 |
| JP | 2955946 | | 10/1999 | |

OTHER PUBLICATIONS

L. H. Sperling, Polymer Surfaces and Interfaces: The Need for Uniform Terminology, 1995, ACS Division of Polymeric Materials: Science and Engineering (PMSE).

A. D. Jenkins et al., Glossary Of Basic Terms In Polymer Science 1996, Pure Appl. Chem. vol. No. 68, 8, pp. 1591–1595, 2287–2311.

Kitao, Toshio et al., "Fibers from Polyblends Containing Nylon 6 as Basic Component. I. Melt Spinning and Physical Properties of Blend Fibers", *Journal of Polymer Science*, vol. 11, pp. 22633–22651 (1973).

Bhaumik, K.N. and Deopura, D.L., "Technical Grade Filaments from Polymer Blends of Nylon 6 and Nylon 66", *International Journal of Polymeric Materials*, vol. 18, pp. 71–85 (1992).

* cited by examiner

*Primary Examiner*—Elizabeth M. Cole
(74) *Attorney, Agent, or Firm*—Volpe and Koenig, P.C.

(57) ABSTRACT

A synthetic filament formed from first and second compatible polymers. The first polymer has a first, higher melting temperature melting point and the second polymer has a second, lower temperature melting point that is at least 5° C. lower. The polymers are mixed and extruded to form a filament that has two distinct melting points so that the filament remains stable and can be heat set at a temperature less than the first high temperature. A woven textile is also provided which incorporates the filaments in at least some of the machine direction and cross direction yarns.

9 Claims, 2 Drawing Sheets

POLYMER ALLOYS INCLUDING TWO OR MORE COMPONENTS WITH DIFFERING MELTING POINTS, FILAMENTS MADE THEREOF, AND FABRICS MADE THEREFROM

FIELD OF THE INVENTION

The present invention concerns a polymer alloy, filaments made thereof, and fabrics made therefrom, which alloy is comprised of two compatible polymers having sufficient interfacial adhesion so as to remain bonded together as an extrudate, characterized in that one of the two component polymers has a higher melting point temperature than the second. Industrial fabrics in which at least a portion of the component filaments are formed from the polymer alloy exhibit reduced susceptibility to curl along their longitudinal edges.

BACKGROUND OF THE INVENTION

Industrial textiles are well known and have a variety of uses, including carpeting, filtration and papermaking. Industrial textiles which are used in papermaking machines to drain and form the incipient paper web, known in the art as forming fabrics, must simultaneously possess a number of physical characteristics for them to be of value. At a minimum, they must be: resistant to abrasive wear, structurally stable, resistant to dimensional changes due to moisture absorption, resistant to stretch and edge curl under tension, as well as resistant to chemical degradation caused by the various materials present in both the stock and in cleansing solutions which are used to clean the fabrics at the prevailing temperatures of use.

Of the various polymers available for use in forming filaments intended for industrial textile applications, those most commonly used in papermaking fabrics are: polyesters, in particular polyethylene terephthalate (PET), polybutylene terephthalate (PBT), polyethylene naphthalate (PEN), and their various copolymers; and polyamides, particularly polycaprolactam or nylon-6 (hereinafter referred to as polyamide-6), polyhexamethylene adipamide or nylon 6/6 (hereinafter referred to as polyamide-6/6), poly (hexamethylene sebacamide or nylon-6/10 (hereinafter referred to as polyamide-6/10), poly(11-aminoundecanoic acid) or nylon-11 (hereinafter referred to as polyamide-11) and poly(hexamethylene dodecanoamide) or nylon-6/12 (hereinafter referred to as polyamide-6/12); other polyamides are known and used.

Although filaments formed from both polyesters and polyamides are suitable for many industrial textile applications, the physical properties of both polymers can be improved, especially when used in the manufacture of industrial textiles intended for modern, high speed papermaking conditions. Polyester filaments generally provide adequate chemical and dimensional stability, and have good crimping and heatsetting characteristics which make them amenable to the weaving and finishing of industrial textiles; however, their resistance to abrasion could be improved so as to increase the service life of the fabrics into which they have been incorporated. Although polyamides have adequate properties for many applications, polyamide filaments have serious deficiencies for weaving and finishing as they exhibit poor crimpability and heatsetting behaviour, and generally do not possess adequate dimensional stability in the moisture range found in the paper making environment.

A further problem is that forming fabrics woven from either polyester, or alternating polyester and polyamide filaments, are subject to edge curl, a phenomenon in which the longitudinal edges of the fabric will either curl up and out of the plane of use, or will curl downwards and run in abrasive contact with the various stationary elements of the papermaking machine. This phenomenon is frequently observed in textiles following their weaving and removal of the fabric from the loom; it is particularly undesirable in forming fabrics which must be flat and generally macroscopically planar when in use so as to form the sheet uniformly, and resist wear along their marginal edges. Edge curl persists in the textile following heatsetting, and is well documented in the patent literature.

Heatsetting is a process used to stabilize a woven or nonwoven textile structure so as to set filament crimp and thereby prevent any deformation of the textile when in use. This is typically accomplished by applying heat to the fabric while it is under tension in at least one direction; the heat will soften the component filaments and lock them in position about one another during cooling. The temperature to which the fabric is heated during the heatsetting process will normally lie between the glass transition temperature and the melting point temperature of the component filaments. The applied tension and heat will cause the filaments to be permanently deformed and crimped about one another at their cross-over points. However, it is quite common for the edges of the textile to remain curled to some extent either up or down out of the plane of the fabric following this heatsetting process, necessitating further treatment (usually of the edges only) in order to render the textile usable.

Numerous attempts have been made to overcome the problems associated with both edge curl and dimensional stability of polyamide filaments in industrial textiles. These can be broadly broken down into mechanical means, chemical and heat treatment means. In the following discussion and hereinafter, the term "filament" is intended to be construed as synonymous with the terms "yarn", "fiber", "monofilament" and the like which are common in the textile arts and which are intended to denote a fundamental unit used in the construction of an industrial textile, generally, a fiber of indefinite length.

There are several known mechanical means to accomplish this objective. One method disclosed in U.S. Pat. No. 4,941,239 requires sanding off approximately ¼ of the fabric mass from its outer, paper side surface edges.

Another method disclosed in U.S. Pat. No. 5,546,643 requires cutting slits into the paper side weft yarn knuckles along the lateral edges of the fabrics. This scoring of the weft yarns reduces the ratio between the cross machine direction shrinkage forces acting on the sides of the fabric to reduce the tendency to curl.

Another method known from U.S. Pat. No. 4,452,284 to reduce edge wear and curl is to weave the warp yarns along the longitudinal edges of the fabric at a lower tension than those in the central portion, or to utilize yarns at the lateral edges which are capable or greater elongation than those used in the central portion, such as polyamide edge yarns and polyester central yarns.

Another method proposed in WO 99/00546 to control edge curl is to score and notch the weft yarns along the longitudinal edges of the fabric by means of an ablation laser.

Yet another method disclosed in U.S. Pat. No. 4,453,573 is to utilize a modified, conventional unbalanced weave wherein every second warp pattern is reversed so as to improve fabric drainage and sheet support, as well as eliminate edge curl.

All of these mechanical methods that sand or score the fabric have an adverse impact on fabric life. As well, the methods which include specialized weaving requirements require additional manufacturing time and/or specialized equipment.

It has also been proposed to reduce fabric edge curl by chemical means. U.S. Pat. No. 5,324,392 teaches that monofilament made from a unique polyamide-6 which is manufactured in the specified manner provides good crimp and shrinkage characteristics. These yarns are used as at least the weft yarns in weaving single or multi-layer forming fabrics which are allegedly stable and resist edge curl. Specialized polyester monofilaments have also been proposed in U.S. Pat. No. 5,116,478 for the same intended end use which have similar crimp and shrinkage characteristics, as well as good wear resistance properties.

Another proposal to control edge curl is disclosed in U.S. Pat. No. 4,281,688 wherein the use of a weave pattern which introduces weft yarn floats and/or knuckles of differing sizes is taught.

GB 2,328,452 discloses controlled cooling of industrial textiles by means of a blower located immediately downstream of the heatsetting chamber, or following the return roll, so as to provide a uniform flow of cooling air across the fabric surface to minimize fabric distortion and edge curl following heatsetting.

None of these aforementioned teachings has met with complete success in eliminating edge curl in industrial textiles. One common means of reducing fabric edge curl is to increase the temperature at which the textile is heatset, at least at its lateral edges, so that it is close to the melting temperature of the component yarns. This practice is somewhat effective, however, other desirable physical properties of the textile, such as its finish, surface characteristics, permeability to air and fluids, and resistance to hydrolytic degradation, may be significantly diminished. It would therefore be desirable to provide a woven textile and, in particular, a paper making fabric, that is not subject to edge curl, can be produced on conventional looms, and which provides adequate textile properties for the intended end use application, in particular with respect to the crimpability of the component yarns, heatsetting behaviour of the textile and its resistance to abrasive wear.

SUMMARY OF THE INVENTION

In a first broad embodiment, the present invention provides a polymer alloy formed from first and second polymers which are mutually compatible and which exhibit sufficient interfacial adhesion so as to remain bonded together following mixing, melting and extrusion. The polymer alloy is comprised of a first polymer having a first, higher temperature melting point and a second polymer having a second, lower temperature melting point. The first and second polymers are mixed so that upon blending and melting, two distinct melting points are observed in the polymer alloy extrudate, and the extrudate remains stable at a temperature which is lower than the first, higher temperature melting point but which is higher than the second lower temperature melting point so as to allow permanent plastic deformation of the extrudate. Preferably, the first higher temperature melting point is at least 5° C. greater than the second lower temperature melting point. The first and second melting point temperatures are preferably determined by means of Differential Scanning Calorimetry (DSC); other methods may be suitable. When this preferred method is used, the melting points of the polymers in the alloy are defined by the peaks of the heat flow/temperature curve provided by the DSC apparatus.

In a second broad embodiment, the present invention provides a synthetic filament formed from a polymer alloy comprised of first and second polymers which are mutually compatible and which exhibit sufficient interfacial adhesion so as to remain bonded together following mixing, melting and extrusion. The first polymer has a first, higher temperature melting point and the second polymer has a second, lower temperature melting point. The first and second polymers are mixed so that following blending, melting and extrusion of the polymer alloy in filamentary form, two distinct melting points are observed in the resulting extrudate. The extrudate will remain stable when exposed to a temperature which is lower than the first, higher temperature melting point and which is greater than the second, lower temperature melting point. Preferably, the first higher temperature melting point is at least 5° C. greater than the second lower temperature melting point as determined by DSC.

In a third broad embodiment, the present invention provides an industrial textile formed from a machine direction (MD) yarn system interwoven with a cross-machine direction (CD) yarn system, wherein at least one of the MD and CD yarn systems includes a filament formed from a polymer alloy of first and second polymers which are mutually compatible and which exhibit sufficient interfacial adhesion so as to remain bonded together following mixing, melting and extrusion. The first polymer has a first, higher temperature melting point and the second polymer has a second, lower temperature melting point. The first and second polymers are mixed so that following blending, melting and extrusion of the polymer alloy in filamentary form, two distinct melting points are observed by DSC in the resulting extrudate. The extrudate will remain cohesive when exposed to a temperature which is lower than the first, higher temperature melting point and which is greater than the second, lower temperature melting point. Preferably, the first higher temperature melting point is at least 5° C. greater than the second lower temperature melting point when determined by DSC.

Industrial textiles into which these filaments are incorporated as at least a portion of either, or both, the interwoven MD or CD yarn systems are heatset at a temperature that is at least equal to, and is preferably greater than, the second, lower melting point temperature, but which is lower than the first higher temperature melting point. The resulting fabrics exhibit reduced propensity for edge curling when compared to comparable fabrics of the prior art, and are dimensionally stable and resistant to abrasive wear when in use.

Preferably, the polymer alloy of the present invention is comprised of a first polymer whose higher temperature melting point is greater than 200° C. and a second polymer whose lower temperature melting point is less than 200° C., both temperatures being determined by DSC. Alternatively, the first polymer has a higher temperature melting point which is greater than 190° C. and a second polymer has a lower temperature melting point is less than 190° C., both temperatures being determined by DSC. As a further alternative, the first polymer has a higher temperature melting point which is greater than 180° C. and a second polymer has a lower temperature melting point is less than 180° C., both temperatures being determined by DSC.

As used herein, the phrase "melting point temperature" refers to the actual temperature at which, in a semi-crystalline polymer, the last traces of crystallinity disappear under equilibrium conditions and the polymer melts and flows. In the preferred embodiments described herein, all of the polyester and polyamide polymers are of the semi-crystalline type. All melting point temperatures provided are determined by means of Differential Scanning Calorimetry (DSC). The melting point temperatures of the polymers are represented by a peak in the heat flow/temperature graph.

Preferably, the polymer alloy of the present invention is comprised of from 50% to 99% by weight of the first higher temperature melting point polymer, and from 1% to 50% by weight of the second lower temperature melting point polymer, with the percentages by weight being based on the total weight of the polymer system.

In one particular embodiment which is presently preferred, the first higher temperature melting point polymer is polyamide-6/10 and the second lower temperature melting point polymer is polyamide-11.

In a second particular embodiment which is also presently preferred, the first higher temperature melting point polymer is polyamide-6 and the second lower temperature melting point polymer is polyamide-11.

In a third particular embodiment which is also presently preferred, the first higher temperature melting point polymer is polyamide-6/12 and the second lower temperature melting point polymer is polyamide-11.

Preferably, the melting point temperatures of the first and second polymers are determined in the polymer alloy by means of Differential Scanning Calorimetry (DSC).

It will be understood by those of skill in the art that other polymers which are compatible, exhibit sufficient interfacial adhesion so as to remain bonded together, and which have differing melt points, may also be used to form the polymer alloy of the present invention.

BRIEF DESCRIPTION OF THE DRAWING(S)

The foregoing summary, as well as the following detailed description of the preferred embodiments of the invention will be better understood when read in conjunction with the appended Figures. For the purpose of illustrating the invention, there are shown in the Figures embodiments which are presently preferred. It should be understood, however, that the invention is not limited to the precise arrangements shown.

DETAILED DESCRIPTION OF THE PREFERRED EMBODIMENT(S)

The polymer alloy of the present invention and yarns comprised thereof, are prepared in accordance with processes and procedures well known to those of skill in the art of plastics extrusion. Briefly, the polymer alloy of the invention and filaments comprised thereof are prepared as follows. The first and second polymers to be combined in the polymer alloy are selected based on their anticipated compatibility, interfacial adhesion and difference in melting points, which is preferably at least 5° C. The polymers are obtained in pellet form from a suitable supplier and are then dry blended in appropriate relative amounts as specified below; tumble blending of the pellets will provide acceptable results. Preferably, melting and mixing of the first and second polymers will occur under conditions typically specified for the higher melting component according to the polymer supplier's recommendation.

Additives such as dyes, lubricants, antioxidants, plasticizers, stabilizers or other materials commonly employed in the production of extrusions may be used as deemed necessary. Polymeric compatibilizers can be added to improve compatibility between the first and second polymers. The resulting filaments may also be coated with a lubricant and/or anti-static agent to enhance handling in subsequent processing operations.

The dry blended mixture is then fed to an appropriate melt mixer, such as a single or twin screw extruder or a kneader. Alternatively, the first and second polymers, as well as any additives, may be separately metered into the melt mixing apparatus and mixed therein.

The resulting polymer alloy is then pushed from the extruder or kneader through an orifice or die and is quenched in air or water or other suitable medium at a controlled temperature so as to solidify the extrudate. It is often advantageous to use a pump, such as a gear pump, to regulate the pressure between the extruder or kneader and the die. A reduction in the cross-sectional area of the extrudate relative to that of the die orifice will usually be found.

The solidified extrudate is optionally stretched in a typical yarn forming process to orient the extrudate and modify certain physical properties so that the resulting product is suitable for its intended end use application; this orientation process may involve one or more drawing stages and optionally a shrinking or "relax" stage, all at controlled temperature and tension.

The first higher temperature melt point polymer will comprise from about 50% to about 99% by weight of the polymer alloy, and the second lower temperature melt point polymer will comprise from about 50% to about 1% by weight of the polymer alloy, the percentages by weight being based on the total weight of the polymer system.

Figure 1:
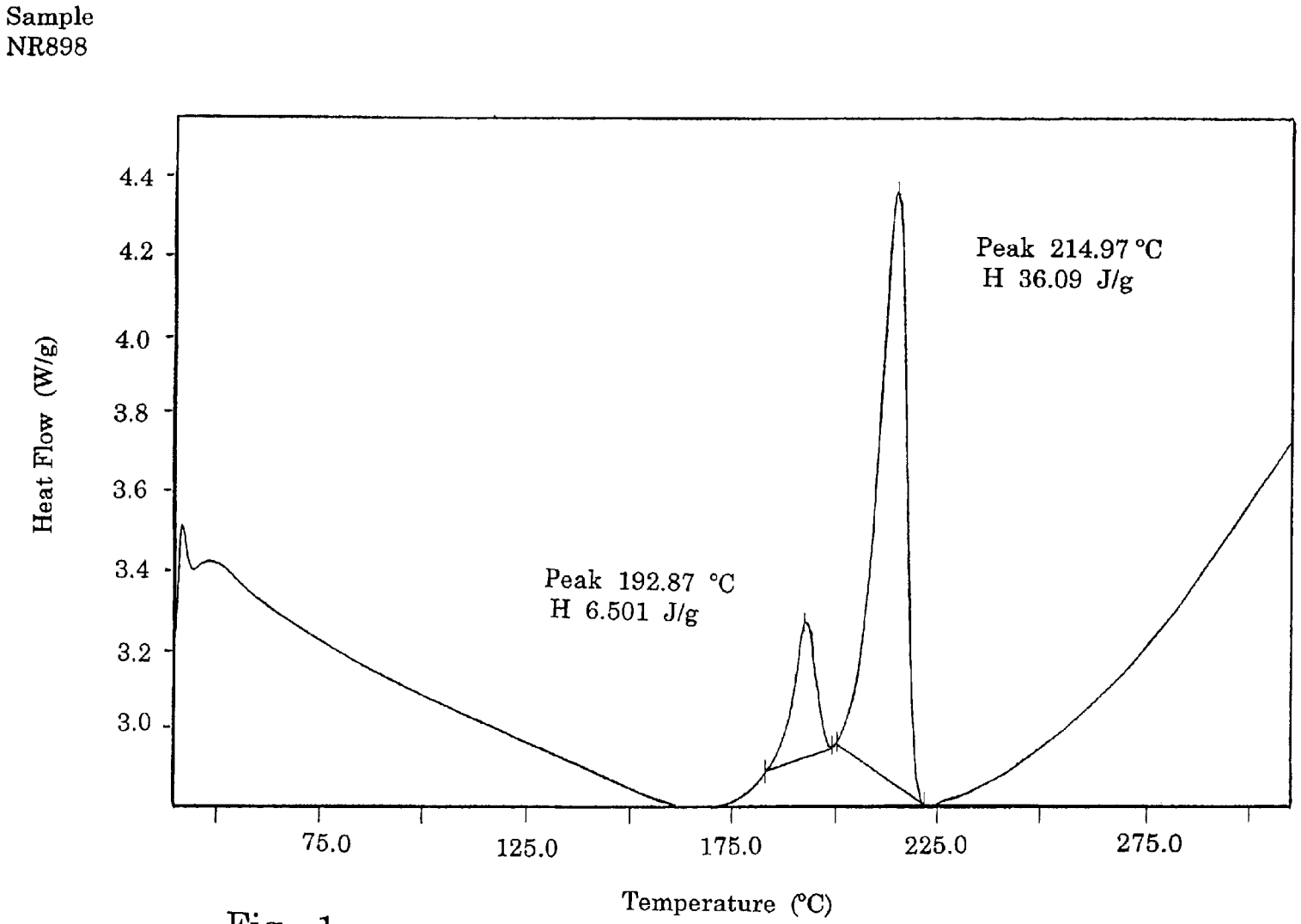
FIG. 1 is a Digital Scanning Calorimetry (DSC) graph indicating the two distinct melting points of a polymer alloy in accordance with the present invention.

The first polymer will preferably have a melting point temperature which is at least 5° C. higher than that of the second polymer, with the melting points of both polymers being determined by DSC, for example as shown in FIG. 1, from the finished polymer alloy. In one preferred embodiment, the melting point temperature of the first polymer is greater than 200° C. and the melting point temperature of the second polymer is less than 200° C., there being at least 5° C. difference between the two melting point temperatures. This has significance in connection with papermaking fabrics which may be assembled from the yarns of this invention and which are generally heatset at about 200° C.

The first polymer for use in the polymer alloy of the present invention can be any fiber forming polymer which is compatible with the second polymer chosen for use in the alloy and which has a melting point temperature that is at least 5° C. greater than the melting point temperature of the second polymer.

Generally speaking, polyamides, copolyamides, polyesters and copolyesters with melt temperatures in the range of about 200° C. are suitable candidate polymer groups from which the first and second polymers may be selected. Specifically, polyamide-6, polyamide-6/6, polyamide-6/10, polyamide-6/12 and their copolymers are examples of polyamides which we have found to be particularly suitable for use as the first polymer in the polymer alloy of this invention. Polyamide-6/10 or polyamide-6/12 are preferred polymers for use in the manufacture of papermakers fabrics, while polyamide-6/6 or polyamide-6 are preferred for carpet and other industrial applications.

The second polymer suitable for use in the polymer alloy of the present invention can be any polymer whose melting point temperature is lower than, and preferably at least 5° C. below the melting point temperature of the first polymer and which has reasonable compatibility when blended with the first polymer. Reasonable compatibility means that filaments produced from the polymer alloy exhibit sufficient structural integrity and mechanical properties to be useful for the end use applications. Examples of polymer materials suitable for use as the second polymer in the polymer alloy of this invention include: polyamide-11, polyamide-12, various copolyamides, polyesters, copolyesters, rubbery polymers such as EPDM rubbers, and ethylene acrylate copolymers, all of whose melting point temperatures are below 200° C. The combination of polyamide-6/10, which has a melting point temperature of about 220° C., and polyamide-11 which has a melting point temperature of between 160° C. and 209° C. are presently preferred. Table 1 below shows some possible combinations of polymers that would be suitable for use in the practice of this invention:

TABLE 1

Melting Points of First and Second Polymers for Use in Polymer Alloy

| First Polymer | Melting Point Temperature (° C.) | Second Polymer | Melting Point Temperature (° C.) | Temperature Difference (° C.) |
|---|---|---|---|---|
| Polyamide-6/10 | 220 | Polyamide-11 | 180–190 | >30 |
| Polyamide 6 | 210–220 | Polyamide-11 | 180–190 | >20 |
| Polyamide-6/6 | 255–265 | Polyamide-12 | 160–209 | >40 |
| Polyamide-6/12 | 195–210 | Polyamide-11 | 180–190 | >5 |

The melting point temperatures provided in Table 1 are from *Modern Plastics Encyclopedia* '97 *with Buyer's Guide*. Ed. by William A. Kaplan. New York: McGraw-Hill, 1997, and are provided as being merely exemplary. Actual melt temperatures may vary by manufacturer and batch.

These examples are not meant in any way to be limiting with regards to the breadth or scope of the invention. Indeed, it appears that the first polymer can be any fiber forming polymer having a melting point temperature that is sufficiently high, for example above 200° C., 190° C. or 180° C., provided it is combined with a second polymer with which it is compatible and which has a melting point temperature that is less than, and preferably at least 5° C. lower than the melting point temperature of the first polymer.

Samples of the polymer alloy in accordance with the teachings of the present invention were prepared and selected physical properties of filaments made therefrom are reported in Table 3. Five filament samples, designated NR433B, NR433C, NR469B, NR469C and NR898 respectively, were prepared in accordance with the teachings of the present invention. The mixture and extruder type are specified in Table 2 below.

TABLE 2

Filament Sample Extrusion

| | | Sample Extrusion Conditions | | | | |
|---|---|---|---|---|---|---|
| Sample Identification | | NR433B | NR433C | NR469B | NR469C | NR898 |
| Composition (wt. %) | Polyamide-6/10 | 90 | 80 | | | |
| | Polyamide-6 | | | 90 | 80 | |

TABLE 2-continued

| Filament Sample Extrusion | | | | | | |
|---|---|---|---|---|---|---|
| | | Sample Extrusion Conditions | | | | |
| Sample Identification | | NR433B | NR433C | NR469B | NR469C | NR898 |
| | Polyamide-6/12 | | | | | 70 |
| | Polyamide-11 | 10 | 20 | 10 | 20 | 30 |
| Extruder | Extruder Type | Reifenhauser | | | | Kuhne |

Samples NR433B; NR433C; NR469B; and NR469C were extruded from a 28:1 L/D (length of barrel/diameter of barrel) 40 mm single screw extruder with a general purpose screw. The extruder was a Reifenhauser Type EH80-1-40 extruder available from Reifenhauser GmbH & Co. Maschinenfabrik of Troisdorf, Germany. Sample NR898 was extruded using a 60 mm 24:1 L/D single screw extruder with a barrier type screw; the second extruder was a Kuhne type K60-24D manufactured by Kuhne GmbH of St. Augustine, Germany. Filaments were extruded using typical conditions for these types of polymers in extruders of these types.

The melt exiting the extruders was passed through a gear pump, for precise volumetric control, and then pumped through a screenpack, breaker plate and die. The molten strands exiting vertically downward from the die were then passed through a small air gap and solidified or quenched in a temperature controlled water bath. Following extrusion, the yarns were separated in a water bath and run up a drainage tray to a first set of rolls (referred to as a rollstand). They were then passed through an oven to a second rolistand which is usually operated at a higher speed so as to draw or orient the strands. From the second rollstand, the yarns passed through a second oven and from there to a third rolistand to provide a second stage of draw. The yarns then passed through a third oven and then to a fourth rollstand. The fourth rollstand may be run at a lower speed than the third rollstand so as to reduce the shrinkage potential of the yarns. The physical properties of the yarns produced according to the invention are reported in Table 3.

TABLE 3

Properties of yarns formed from polymer alloys

| Sample Description | Designation | Component 1 | Component 2 | Tensile Strength (kg/mm$^2$) | Elongation at Break (%) | Shrinkage @ 200° C. (%) | High Temp. Compressive Permanent Set (1000 mN @ 175° C.) | Relative Abrasion Resistance |
|---|---|---|---|---|---|---|---|---|
| Polyamide-6/10 and Polyamide-11 alloy | NR433B | Rhonel 7030 135 SN 00 Polyamide-6/10 90% by wt. | AtoFina Rilsan BESNO Polyamide-11 10% by wt. | 36 | 65 | 9 | n/a | 2.0 |
| Polyamide-6/10 and Polyamide-11 alloy | NR433C | Rhonel 7030 135 SN 00 Polyamide-6/10 80% by wt. | AtoFina Rilsan BESNO Polyamide-11 20% by wt. | 31 | 67 | 9.5 | 34% | 1.9 |
| Polyamide-6 and Polyamide-11 alloy | NR469B | Basf Ultramide X-301 Polyamide-6 90% by wt. | AtoFina Rilsan BESNO Polyamide-11 10% by wt. | 34 | 70 | 9 | n/a | n/a |
| Polyamide-6 and Polyamide-11 alloy | NR469C | Basf Ultramide X-301 Polyamide-6 80% by wt. | AtoFina Rilsan BESNO Polyamide-11 20% by wt. | 31 | 72 | 8.5 | 46% | 2.7 |
| Polyamide-6/12 and Polyamide-11 Alloy | NR898 | Zytel 158 Polyamide-6/12 70% by wt. | AtoFina Rilsan BESNO Polyamide-11 30% by wt. | 58 | 29 | n/a | 28% | n/a |
| Control: Polyamide-6/10 | NR433A | Rhonel 7030 135 SN 00 Polyamide-6/10 100% by wt. | n/a | 39 | 56 | 6 | 22 | 6.5 |
| Control: Polyamide-6 | NR469A | Basf Ultramide X-301 Polyamide-6 100% by wt | n/a | 34 | 75 | 7 | 32 | 4.5 |

In Table 3, tensile strength of the filament samples was determined using a suitable CRE (constant rate of extension) tensile testing device, such as are available from Instron Corp. of Canton, Mass. equipped with a 50 kg load cell and capstan or snubbing type yarn clamps. The reported tensile strength is the maximum stress that may be applied to the filament at failure and is the quotient of the applied tensile force on the strand in kg divided by the cross-section area of the strand in $mm^2$. The test is performed generally in accordance with the procedures described in ASTM (American Society for Testing and Materials) published Test Methods D76-77, D885-85 and D2256-80 as appropriate.

Also in Table 3, elongation at break ($E_b$) is the percentage increase in the length of the yarn at break under tension as compared to the yarn without tension and is determined using a CRE type tensile testing machine. Elongation (E) is defined as the distance between the base of the load-elongation curve to the point of ultimate tensile strength; depending on available equipment, one means of calculating elongation at break is given as follows; others may be suitable:

$$E_b\ (\%)+((\text{crosshead speed}/\text{chart speed})\times(E/\text{gauge length}))\times 100 \quad [1]$$

Shrinkage @ 200° C. (%) also as reported in Table 3 is the percent reduction in length of the filament following exposure to a temperature of 200° C. for 3 minutes in a suitable convection oven; it is a means of evaluating the consistency of yarns for use in heatsetting and weaving. In this test, the length of an approximately 1 meter filament sample is accurately measured and then formed into a coil approximately 3 inches in diameter. The coil is then placed in a convection oven at 200° C. for 3 minutes and allowed to shrink freely. The coiled sample is then removed, cooled for 2 minutes and its length re-measured. The length difference before and after heating (the shrinkage) is then calculated and expressed as a percent difference in length.

High Temperature Compressive Permanent Set (1000 mN @ 175° C.) as reported in Table 3 is determined from a test used to determine the amount of permanent deformation induced in a strand when subjected to a given amount of elongation at the specified temperature; this deformation is related to the "crimp" induced in a strand in a woven fabric. The test is used to characterize the "crimpability" of a filament at temperatures similar to those used in the heat-setting process. In this test, filament samples are first cut to approximately ½ to ¼ inch in length and then placed in a suitable test apparatus, such as a Dynamic Mechanical Analyzer Model DMA 7e available from Perkin Elmer which has been heated to the desired temperature (175° C.) and allowed to reach equilibrium. A probe then is brought into contact with the sample and applies a force of 20 mN for a period of 2 minutes. Immediately after, the force applied by the probe is increased to 1000 mN and held there for one minute; following this, the probe force is reduced to 20 mN for a further 2 minutes. The diameter of the filament sample is measured in the DMA twice: the first measurement is made just before the end of the initial 2 minutes, and the second measurement is taken at the end of the second 2 minute period. The crimp is then calculated by subtracting the second measurement from the first and dividing the resulting difference by the first measurement and then multiplying by 100 to obtain a percentage. Five samples are normally taken and the final result reported is the average of these five samplings. The higher the percent value obtained, the greater the amount of crimp imparted to the sample and thus the more easily the sample accepts crimp at the chosen temperature.

Relative abrasion resistance, or RAR, as reported in Table 3, is a comparison of the number of abrasion cycles to failure of a test material divided by the number of abrasion cycles to failure of a control. Higher RAR values indicate greater resistance to abrasion. In this test, an abrading surface consisting of 16 stainless steel welding wires, each 1/16" in diameter, are mounted on motor driven twin rotating cylinders that are partially immersed in water. Sample filaments to be tested are fed around and in contact with the immersed portion of the wire cylinders and a weight is then attached to the opposite end of the filament for tensioning against the cylinders. The samples are attached to contact switches at the rear of the test apparatus. The motor is then started so that the wires mounted on the rotating cylinders spin in abrasive contact with the samples; the number of cycles by the cylinders is recorded. When a sample is worn through to break, the switch loses contact and the cycles to failure of the filament are recorded. RAR values of about 2 or more are considered acceptable for filaments intended for use in industrial textile applications such as papermaking, filtration and the like.

In Table 3 above, Sample NR433B consisting of a polymer alloy of 90% by wt. of a first higher melting point temperature polymer which is Rhonel 7030 135 SN 00 Polyamide-6/10 available from Rhodia of Emmenbrücke, Switzerland, and 10% by wt. of a second lower melting point temperature polymer which is Rilsan BESNO Polyamide-11 available from AtoFina of Philadelphia, Pa. In Sample NR433C, the first higher melting point temperature polymer is again Rhonel 7030 135 SN 00 Polyamide-6/10 and comprises 80% of the alloy weight, while the remaining 20% is comprised of Rilsan BESNO Polyamide-11 which is the second lower melting point temperature polymer. In Sample NR469B, the first higher melting point temperature polymer is BASF Ultramid® X-301 polyamide-6 available from BASF of Arnprior, Ontario, which comprises 90% of the alloy weight, and the second lower melting point temperature polymer is Rilsan BESNO Polyamide-11 which comprises the remaining 10%. In Sample NR469C, the first higher melting point temperature polymer is again BASF Ultramid® X-301 polyamide-6 and comprises 80% of the alloy weight, while the second lower melting point temperature polymer is Rilsan BESNO Polyamide-11 and comprises the remaining 20%. In Sample NR898, the first higher melting point temperature polymer is Zytel 158 polyamide-6/12 available from Du Pont de Nemours and Co. of Wilmington, Del. which comprises 70% of the alloy weight, and the second lower melting point temperature polymer is Rilsan BESNO Polyamide-11 which comprises the remaining 30% of the alloy weight. Sample NR433A comprising 100% by wt. Rhonel 7030 135 SN 00 Polyamide-6/10 was used as a control sample.

The data reported in Table 3 shows that critical physical properties of filaments prepared from the novel polymer alloy of this invention exhibit adequate tensile strength, elongation, crimping characteristics and resistance to abrasion which would make them suitable for use in industrial textiles.

Each of the samples reported in Table 3 was then tested to determine their propensity to impart edge curl in industrial textiles. The test results are reported in Table 4 below:

TABLE 4

Edge Curl Test Results

| Sample Description | Designation | Edge Curl Dry (cm) | Edge Curl Wet (cm) | Difference, d (cm) |
|---|---|---|---|---|
| Polyamide-6 | BS22R | 0.6 | 8.5 | 7.9 |
| Commercial Low Curl Nylon product | XA930 | 0.25 | 4.6 | 4.4 |
| Polyamide-6/10 and Polyamide-11 alloy | NR433B | 0.4 | 1.8 | 1.4 |
| Polyamide-6/10 and Polyamide-11 alloy | NR433C | 0.35 | 1.4 | 1.1 |
| Polyamide-6 and Polyamide-11 alloy | NR469B | 0.2 | 3.5 | 3.3 |
| Polyamide-6 and Polyamide-11 alloy | NR469C | 0.2 | 3 | 2.8 |
| Polyamide-6/12 and Polyamide-11 Alloy | NR898 | 0.2 | 0.3 | 0.1 |

Figure 2:
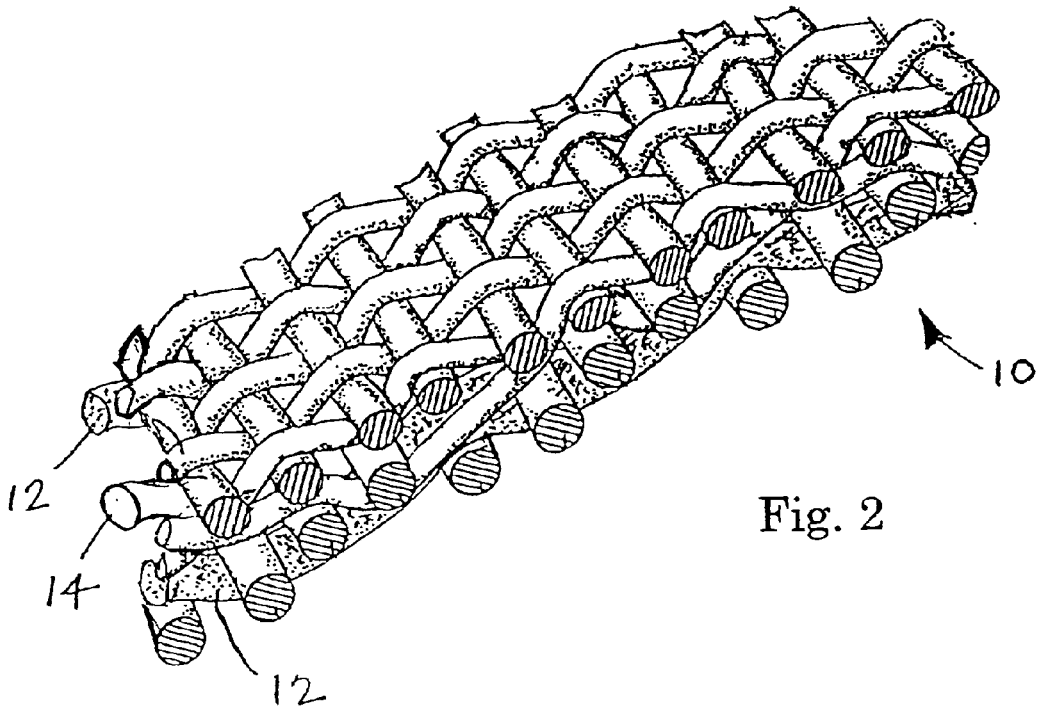
FIG. 2 is a perspective view of a textile woven with the filaments in accordance with the present invention.
Figure 3:
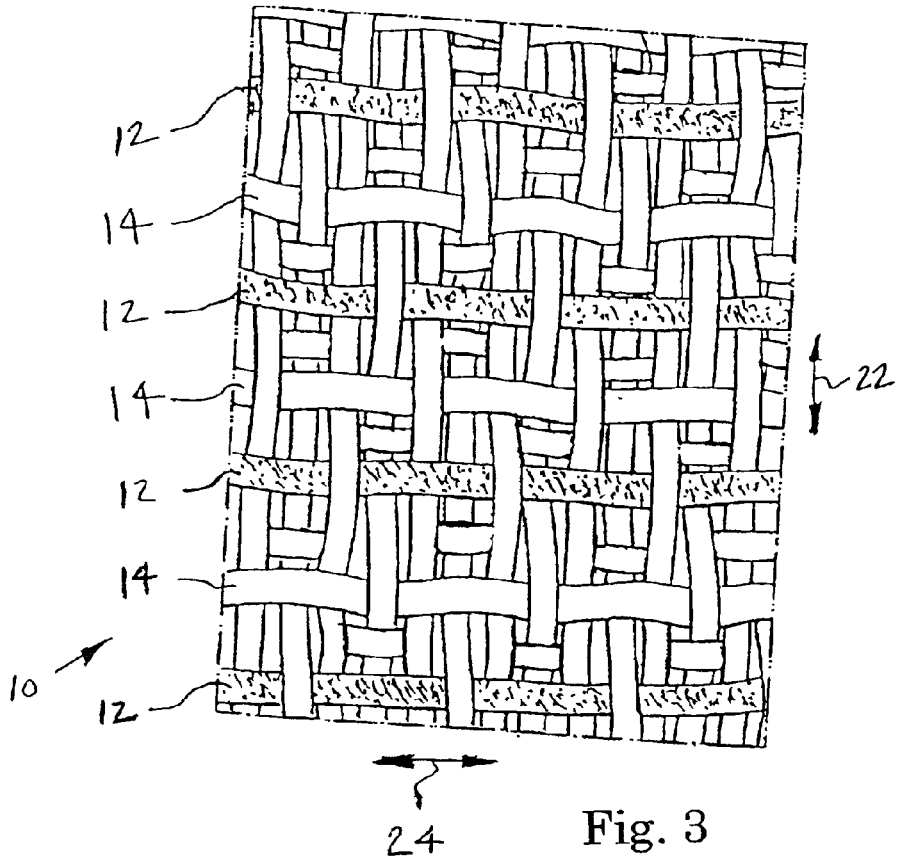
FIG. 3 is a bottom view of the textile of FIG. 2.

In Table 4 above, sample monofilaments made in accordance with the teachings of the present invention are compared to commercially available single component polyamide monofilaments available from EMS Grilon of Sumter, S.C.; these comparison samples are designated as samples BS22R and XA930 in Table 4 above. All filament samples reported in Table 4 were 0.30 mm in diameter. The monofilaments were woven into identical textile samples 10, all woven according to the same weave pattern, as shown in FIGS. 2 and 3, (a triple layer forming fabric design as shown, for example, in U.S. Pat. No. 5,826,627, which is incorporated by reference herein as if fully set forth) in which the sample polyamide monofilaments 12 alternated with monofilaments 14 formed from polyester for the weft yarns on one surface (the machine side, or MS) of the fabric sample. The textile samples 10 were then compared to assess the impact of each polymer or polymer alloy on the tendency of the sample fabrics to curl at their edges. While the textile samples 10 were woven in accordance with one known design, those skilled in the art will recognize from the present disclosure that other weave patterns could be used.

Fabric edge curl was determined as follows. Following weaving, each fabric sample was first cut to the same standard size and then heatset at the same temperature of about 200° C. and at the same longitudinal and lateral tensions. Following heatsetting, all fabric samples exhibited some curling at their longitudinal edges. To determine and compare the amount of dry curl, each sample was laid on a flat surface proximate a vertical scale. The dry edge curl reported in Table 4 is the height attained by the edge of the dry fabric sample due to its curling following heatsetting, as measured in cm from the flat surface to the highest point on the scale reached by the edge of the curled sample.

The heatset sample fabrics were then soaked in room temperature tap water for 24 hours water so as to measure any change in edge curl when the samples are wet. Following soaking, the edge curl in the fabric samples was measured using the same procedure as described above; this is the wet curl. The difference, d, between the dry and wet curl values is taken to be an indication of the dimensional stability of the fabric with respect to edge curling; the smaller the difference d, the more dimensionally stable the fabric under dry-to-wet conditions. As can be seen from the values in Table 4, all of the fabric samples made from filaments prepared in accordance with the teachings of the invention exhibited surprisingly low values of d when compared to the commercially available products designated BS22R and XA930.

A separate test was run using filament sample NR898; this material was woven into a sample fabric using the same weave design and heatsetting parameters as were used in conjunction with the other samples reported in Table 4. The NR898 material is a higher tensile strength version of the other polymer blend filaments reported above due to its higher draw (when compared against the other samples reported in Table 1, the Roll 4:Roll1 speed ratio of sample NR898 is significantly higher). Following edge curl testing, sample NR898 was found to exhibit a significantly lower dry-to-wet edge curl difference than the fabrics produced with commercially available filaments.

The filaments 12 manufactured in accordance with the teachings of this invention were incorporated into the woven textile 10 shown in FIG. 3. While the monofilaments 12 are used in the cross direction (CD) 24 yarn system, it could be used in the machine direction (MD) 22 yarn system and/or both the MD and CD yarn systems, depending upon the particular application and properties desired. The woven textile 10 is woven in a conventional manner. In the sample textile 10, the monofilament 12 is used in the lower, or machine side, surface of the textile and is arranged so as to alternate with another type of component such as a polyester filament. The woven textile 10 may be an industrial textile, and in a preferred application is used as a papermaking fabric. The monofilament 12 exhibits improved crimping properties at temperatures above the melting temperature of the second polymer, which is preferably below about 200° C. This results in the woven textile 10 exhibiting a reduced propensity to curl along its longitudinal edges, which results in a cost savings in the production of such woven textiles and eliminates the need for further processing to eliminate or reduce edge curl, which involves added processing costs and the possibility of damage to the woven textile, which in the case of papermaking fabrics, can render the fabric unusable.

Those skilled in the art will recognize that the polymer alloys of this invention will have uses outside the field of industrial textiles. For example, oriented fibers intended for use in carpeting cannot be crimped easily. Carpet fibers produced from the polymer alloy of this invention can be oriented and crimped following this step. Those skilled the art of producing nylon carpet fibers recognize that they must limit the production rate of these fibers to avoid fully orienting them. Once fully oriented, the fibers can not be "texturized" or crimped (shaped) in subsequent processing steps. This texturizing or crimping puts shape into the fiber in order to give the carpet desirable aesthetic properties.

Carpet fibers produced from the polymer alloys of this invention can be produced at higher rates than have been possible previously and the fibers can be fully oriented. They can still be thermally texturized because shaping these fibers is controlled by the minor component and not strictly by the degree of orientation, as was the case in prior art fibers.

There are many other fiber applications where crimping or other thermal shaping processes rely upon using fibers with less than the maximum degree of orientation to allow for subsequent thermal shaping. The fiber and filament polymer alloys of the present invention allow higher performance processes and products to result due to their surprising ability to be thermally shaped in spite of their degree of orientation. Other applications will also become apparent to those skilled in the art based on the unique characteristics of the present invention.

What is claimed is:

1. An industrial textile comprising an MD yarn system interwoven with a CD yarn system, at least one of the MD and CD yarn systems comprising a filament formed from first and second polymers that are compatible and have sufficient interfacial adhesion to remain bonded together that are mixed as alloys and extruded, the first polymer is selected from the group consisting of Polyamide 6/6, Polyamide 6/10 or Polyamide 6/12, and has a first, higher temperature melting point that is at least 50° C. higher than a second, lower temperature melting point of the second polymer which is selected from the group consisting of Polyamide 11 or Polyamide 12, and the first and second polymers are mixed so that upon heating, two distinct melting points are observed, and at a temperature less than the first, high temperature the filament remains stable and can be heat set with reduced internal strain in the filament;

the interwoven MD and CD yarn systems being heat set at a temperature at least equal to the second, lower melting point temperature resulting in a fabric with a wet edge curl that is generally within a range of 4.5 times the dry edge curl.

2. The industrial textile of claim 1, wherein the first, higher temperature melting point is >200° C. and the second, lower temperature melting point is <200° C.

3. The industrial textile of claim 1, wherein the first polymer is a majority component of the filament.

4. The industrial textile of claim 1, wherein the industrial textile is a paper making fabric and is heat set at a temperature of about 200° C. or less, and the second polymer melts during heat setting in order to relieve strain the fabric due to heat setting, resulting in a paper making fabric with reduced edge curl.

5. The industrial textile of claim 4, wherein the edge curl has a value d that is approximately 1.4 cm or less.

6. The industrial textile of claim 1, wherein the textile has at least a 20% reduction in edge curl in comparison to a heat set textile formed of identical interwoven MD and CD yarn systems consisting of only one of the first or second polymer.

7. An industrial textile comprising an MD yarn system interwoven with a CD yarn system, at least one of the MD and CD yarn systems comprising a filament formed from first and second polymers that are compatible and have sufficient interfacial adhesion to remain bonded together that are mixed as alloys and extruded, the first polymer is selected from the group consisting of Polyamide-6/6, Polyamide-6/10 and Polyamide-6/12, and has a first, higher temperature melting point that is at least 5° C. higher than a second, lower temperature melting point of the second polymer which is selected from the group consisting of Polyamide-11 and Polyamide-12, and the first and second polymers are mixed so that upon heating, two distinct melting points are observed, and at a temperature less than the first, high temperature the filament remains stable and can be heat set with reduced internal strain in the filament;

the interwoven MD and CD yarn systems being heat set at a temperature at least equal to the second, lower melting point temperature resulting in a heat set fabric with a reduced wet edge curl.

8. The industrial textile of claim 7, wherein the industrial textile is a paper making fabric and is heat set at a temperature of about 200° C. or less, and the second polymer melts during heat setting in order to relieve strain in the MD and CD yarns of the fabric due to heat setting.

9. The industrial textile of claim 7, wherein the heat set fabric has an edge curl value d of about 1.4 cm or less.

* * * * *

UNITED STATES PATENT AND TRADEMARK OFFICE

CERTIFICATE OF CORRECTION

PATENT NO. : 6,828,261 B2
DATED : December 7, 2004
INVENTOR(S) : Soelch et al.

It is certified that error appears in the above-identified patent and that said Letters Patent is hereby corrected as shown below:

Column 15,
Line 11, after the word "least", delete "50° C" and insert therefor -- 5° C --.

Signed and Sealed this

Twenty-fifth Day of January, 2005

JON W. DUDAS
*Director of the United States Patent and Trademark Office*

UNITED STATES PATENT AND TRADEMARK OFFICE

CERTIFICATE OF CORRECTION

PATENT NO. : 6,828,261 B2
DATED : December 7, 2004
INVENTOR(S) : Soelch et al.

It is certified that error appears in the above-identified patent and that said Letters Patent is hereby corrected as shown below:

Column 15,
Line 11, after the word "least", delete "50° C" and insert therefor -- 5° C --.

Signed and Sealed this

Thirty-first Day of May, 2005

JON W. DUDAS
*Director of the United States Patent and Trademark Office*